US009458528B2

(12) United States Patent
Boselli et al.

(10) Patent No.: US 9,458,528 B2
(45) Date of Patent: Oct. 4, 2016

(54) 2XXX SERIES ALUMINUM LITHIUM ALLOYS

(71) Applicant: Alcoa Inc., Pittsburgh, PA (US)

(72) Inventors: Julien Boselli, Pittsburgh, PA (US); Jen Lin, Export, PA (US); Roberto J. Rioja, Murrysville, PA (US); Feyen Gerriet, Solihull (GB); Khurram Shahzad Chaudhry, High Wycombe (GB)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 13/798,750

(22) Filed: Mar. 13, 2013

(65) Prior Publication Data

US 2013/0302206 A1 Nov. 14, 2013

Related U.S. Application Data

(60) Provisional application No. 61/644,869, filed on May 9, 2012.

(51) Int. Cl.

| | |
|---|---|
| ***C22C 21/18*** | (2006.01) |
| ***C22C 21/16*** | (2006.01) |
| ***C22F 1/057*** | (2006.01) |

(52) U.S. Cl.

CPC ..... *C22C 21/18* (2013.01); *C22C 21/16* (2013.01); *C22F 1/057* (2013.01)

(58) Field of Classification Search

CPC ..... C22C 1/16; C22C 1/18; C22F 1/057

See application file for complete search history.

(56) References Cited

U.S. PATENT DOCUMENTS

| | | | | |
|---|---|---|---|---|
| 4,961,792 | A | 10/1990 | Rioja et al. | 148/12.7 A |
| 5,137,686 | A | 8/1992 | Rioja et al. | 420/528 |
| 5,211,910 | A | 5/1993 | Pickens et al. | 420/532 |
| 5,259,897 | A | 11/1993 | Pickens et al. | 148/417 |
| 5,389,165 | A | 2/1995 | Cho | 148/552 |
| 5,455,003 | A | 10/1995 | Pickens et al. | 420/529 |
| 2004/0071586 | A1 | 4/2004 | Rioja et al. | 420/532 |
| 2005/0006008 | A1 | 1/2005 | Cho | 148/439 |
| 2006/0011272 | A1 | 1/2006 | Lin et al. | 148/439 |
| 2009/0142222 | A1 | 6/2009 | Colvin et al. | 420/532 |
| 2011/0030856 | A1 | 2/2011 | Warner et al. | 148/552 |
| 2011/0247730 | A1 | 10/2011 | Yanar et al. | 148/550 |

FOREIGN PATENT DOCUMENTS

| | | |
|---|---|---|
| JP | 03-107440 | 5/1991 |
| WO | WO 2009/036953 | 3/2009 |

OTHER PUBLICATIONS

Pickens, J.R. et al., "The Effect of Zn on Nucleation in Al—Cu—Li—Ag—Mg Alloy, Weidalite™ 049 (X2094)", *Aluminium—Lithium,* vol. 1, 1991, DGM Informationsgesellschaft mbH, Germany, pp. 357-362.

(Continued)

*Primary Examiner* — Alexander Polyansky
(74) *Attorney, Agent, or Firm* — Greenberg Traurig, LLP

(57) ABSTRACT

New 2xxx aluminum lithium alloys are disclosed. The aluminum alloys include 3.5-4.4 wt. % Cu, 0.45-0.75 wt. % Mg, 0.45-0.75 wt. % Zn, 0.65-1.15 wt. % Li, 0.1-1.0 wt. % Ag, 0.05-0.50 wt. % of at least one grain structure control element, up to 1.0 wt. % Mn, up to 0.15 wt. % Ti, up to 0.12 wt. % Si, up to 0.15 wt. % Fe, up to 0.10 wt. % of any other element, with the total of these other elements not exceeding 0.35 wt. %, the balance being aluminum.

28 Claims, 3 Drawing Sheets

(56) References Cited

OTHER PUBLICATIONS

"2195—T8R78 Al—Li Plates", Technical Data Sheet, Alcan, 2007.
"AMS4413: Aluminum Alloy, Plate 3.5Cu —1.0Li—0.40Mg—0.35Mn—0.45Ag—0.12Zr (2050-T84) Solution Heat Treated, Stress Relieved, and Artificially Aged", SAE International, 2012.
"AMS4458: Aluminum Alloy, Plate (2.7 Cu—1.8 Li—0.7 Zn) 2099-T86 Solution Heat Treated, Cold Worked and Artificially Aged", SAE International, 2010.
"AMS4472: Aluminum Alloy, Plate 4.0Cu—1.0Li—0.40Mg—0.35Ag—0.13Zr (2195-T34) Solution Heat Treated and Stress Relieved", SAE International, 2011.
International Search Report and Written Opinion, dated Aug. 23, 2013, from co-owned International Application No. PCT/US2013/040136.
Crill, M. J., et al., "Evaluation of AA 2050-T87 Al—Li Alloy Crack Turning Behavior" Materials Science Forum, vols. 519-521, 2006, pp. 1323-1328.
Giummarra, C., et al., "Al—Li Alloys: Development of Corrosion Resistant, High Toughness Aluminum—Lithium Aerospace Alloys", *Aluminum Alloys: Their Physical and Mechanical Properties,* vol. 1, Wiley-VCH Verlag GmbH & Co, KGaA, Weinheim, 2008, pp. 176-188.
Lequeu, Ph., et al., "Aluminum—Copper—Lithium Alloy 2050 Developed for Medium to Thick Plate", Journal of Materials Engineering and Performance, Oct. 2009.

FIG. 1 - Strength (L) v. Toughness (T-L) for Example 1 Alloys
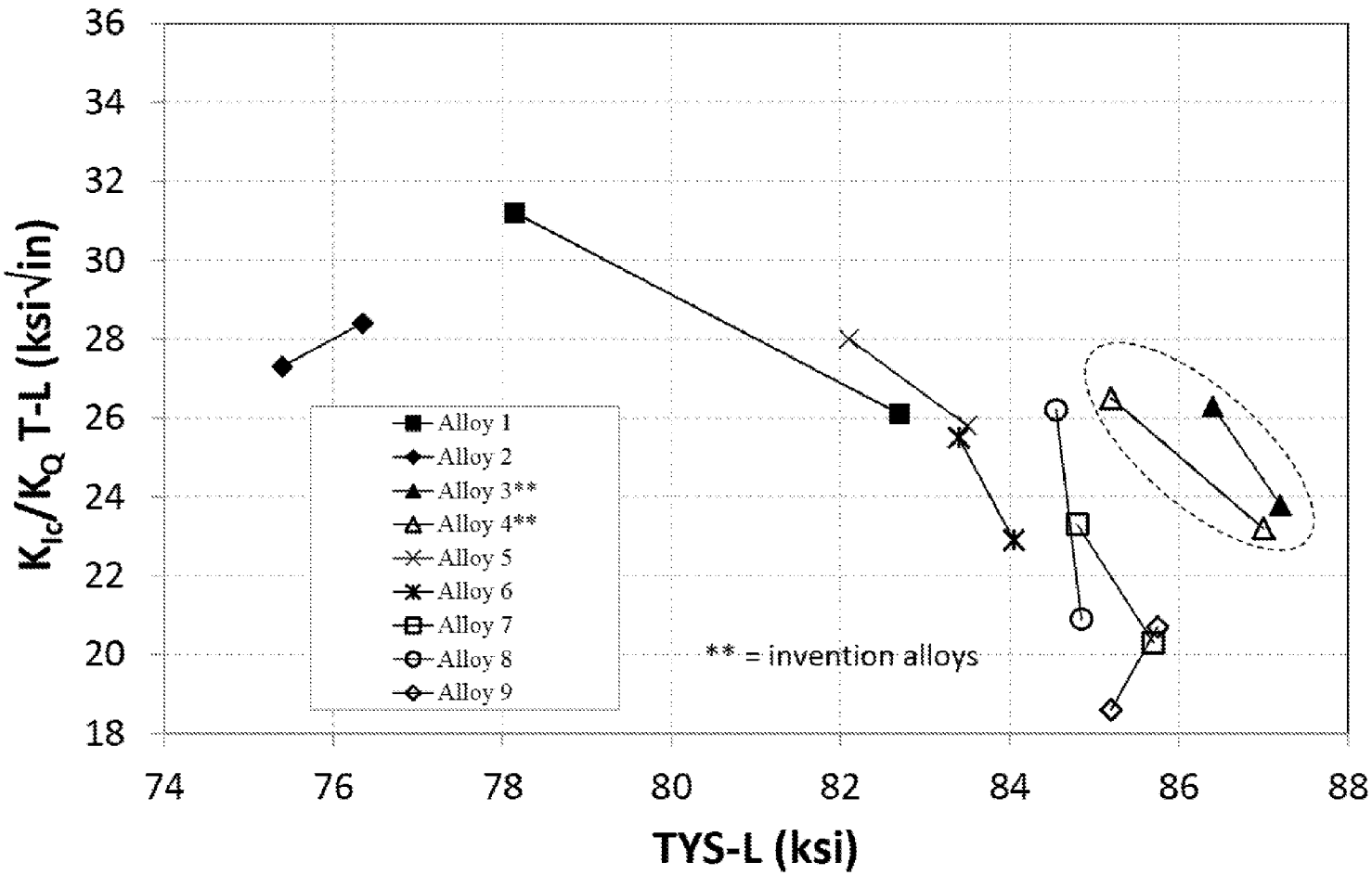

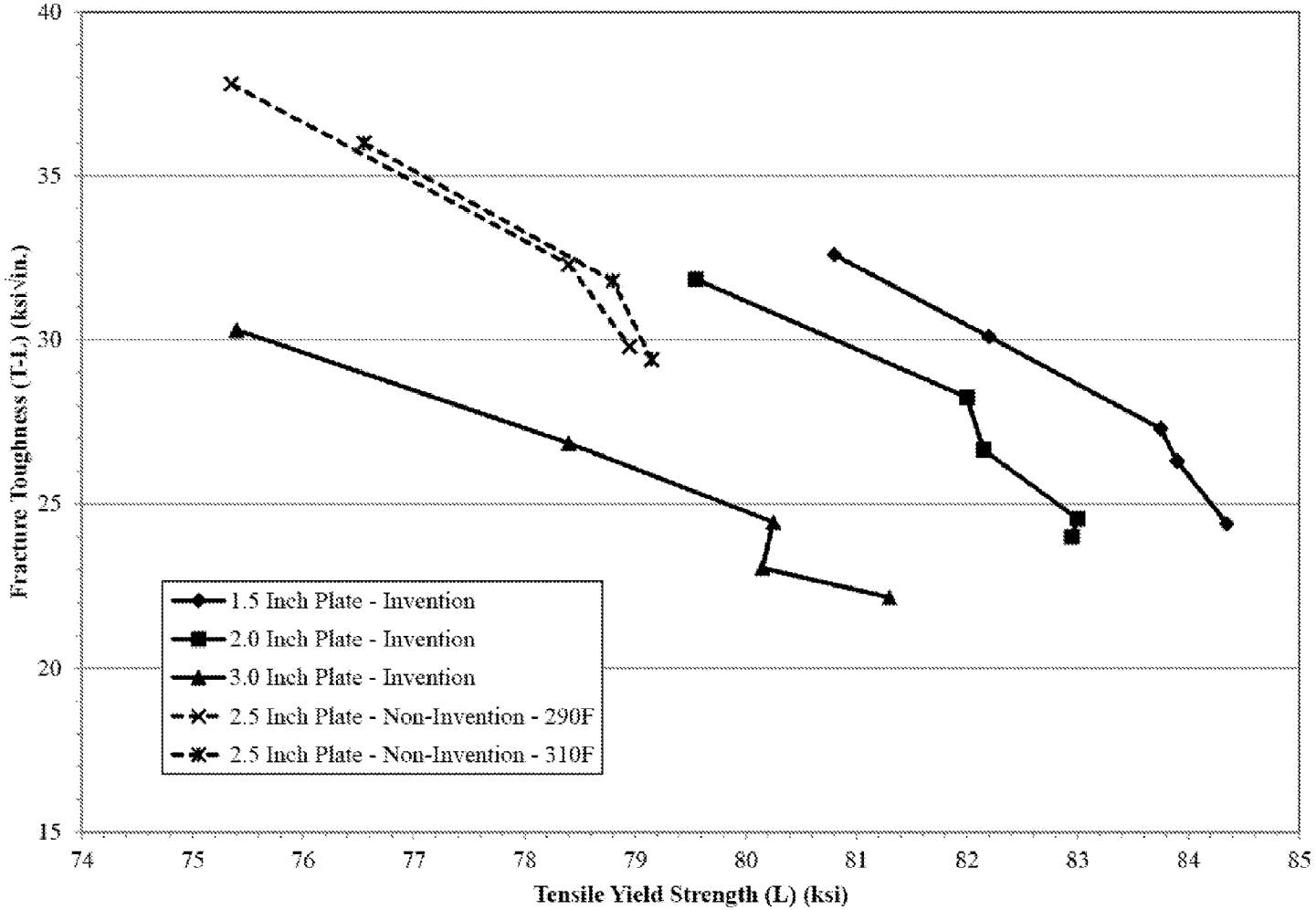
FIG. 2a - Example 2 Alloys - TYS v. Fracture Toughness - L
Fracture Toughness (T-L) (ksi√in.)
40
35
30
25
20
15
74
75
76
77
78
79
80
81
82
83
84
85
Tensile Yield Strength (L) (ksi)
1.5 Inch Plate - Invention
2.0 Inch Plate - Invention
3.0 Inch Plate - Invention
2.5 Inch Plate - Non-Invention - 290F
2.5 Inch Plate - Non-Invention - 310F

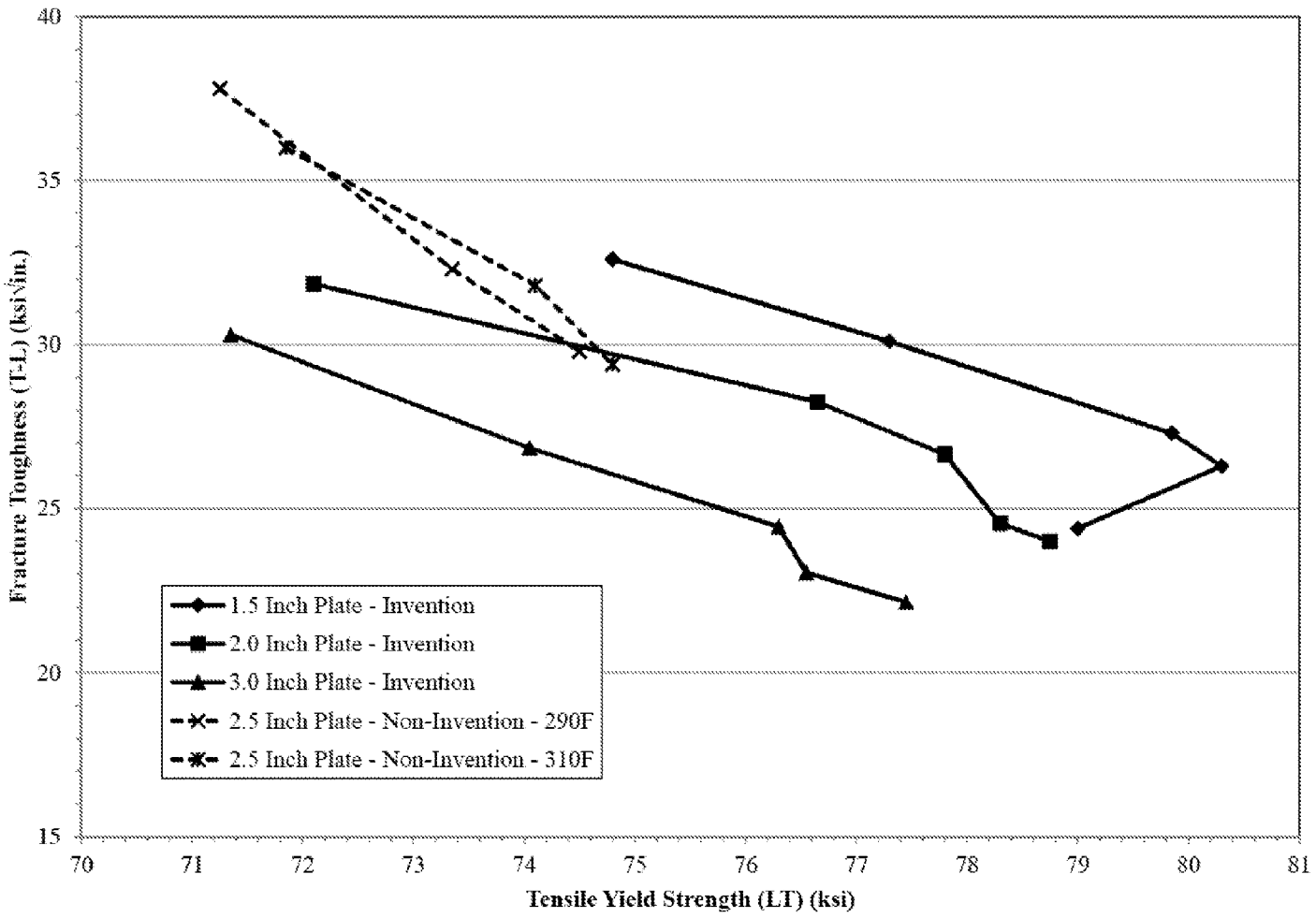
FIG. 2b - Example 2 Alloys - TYS v. Fracture Toughness - LT
Fracture Toughness (T-L) (ksi√in.)
40
35
30
25
20
15
70
71
72
73
74
75
76
77
78
79
80
81
Tensile Yield Strength (LT) (ksi)
1.5 Inch Plate - Invention
2.0 Inch Plate - Invention
3.0 Inch Plate - Invention
2.5 Inch Plate - Non-Invention - 290F
2.5 Inch Plate - Non-Invention - 310F

2XXX SERIES ALUMINUM LITHIUM ALLOYS

CROSS REFERENCE TO RELATED APPLICATION

This patent application claims priority to U.S. Provisional Patent Application No. 61/644,869, entitled "2XXX SERIES ALUMINUM LITHIUM ALLOYS", filed May 9, 2012, and which is incorporated herein by reference in its entirety.

BACKGROUND

Aluminum alloys are useful in a variety of applications. However, improving one property of an aluminum alloy without degrading another property often proves elusive. For example, it is difficult to increase the strength of an alloy without decreasing the toughness of an alloy. Other properties of interest for aluminum alloys include corrosion resistance and fatigue crack growth rate resistance, to name two.

SUMMARY OF THE INVENTION

Broadly, the present patent application relates to 2xxx aluminum lithium alloys. Generally, the 2xxx aluminum lithium alloys have 3.5 to 4.4 wt. % Cu, 0.45 to 0.75 wt. % Mg, 0.45 to 0.75 wt. % Zn, 0.65 to 1.15 wt. % Li, 0.1 wt. % to 1.0 wt. % Ag, 0.05 to 0.50 wt. % of a grain structure control element selected from the group consisting of Zr, Sc, Cr, V, Hf, rare earth elements, and combinations thereof, up to 1.0 wt. % Mn, up to 0.15 wt. % Ti, up to 0.12 wt. % Si, up to 0.15 wt. % Fe, up to 0.10 wt. % of any other element, with the total of these other elements not exceeding 0.35 wt. %, the balance being aluminum. Wrought products incorporating such aluminum alloys may achieve improved properties, such as improved strength and/or toughness and/or corrosion resistance.

In one approach, the wrought aluminum alloy product is a thick wrought aluminum alloy product, i.e., a wrought product having a cross-sectional thickness of at least 12.7 mm. In one embodiment, a thick wrought aluminum alloy product has a thickness of at least 25.4 mm. In another embodiment, a thick wrought aluminum alloy product has a thickness of at least 50.8 mm. In one embodiment, a thick wrought aluminum alloy product has a thickness of not greater than 177.8 mm. In another embodiment, a thick wrought aluminum alloy product has a thickness of not greater than 152.4 mm. In yet another embodiment, a thick wrought aluminum alloy product has a thickness of not greater than 127.0 mm. In another embodiment, a thick wrought aluminum alloy product has a thickness of not greater than 101.6 mm. As used in this paragraph, thickness refers to the minimum thickness of the product, realizing that some portions of the product may realize slightly larger thicknesses than the minimum stated.

In another approach, the wrought aluminum alloy product is a thin wrought aluminum alloy product, i.e., a wrought product having a cross-sectional thickness of less than 12.7 mm, such as thin-gauge plate or sheet. In one embodiment, a thin wrought aluminum alloy product has a thickness of at least 1.0 mm. In another embodiment, a thin wrought aluminum alloy product has a thickness of at least 1.27 mm. In yet another embodiment, a thin wrought aluminum alloy product has a thickness of at least 1.52 mm. In one embodiment, a thin wrought product has a thickness of not greater than 10.2 mm. In another embodiment, a thin wrought product has a thickness of not greater than 7.62 mm. In yet another embodiment, the thin wrought product has a thickness of not greater than 6.35 mm. As used in this paragraph, thickness refers to the minimum thickness of the product, realizing that some portions of the product may realize slightly larger thicknesses than the minimum stated.

Copper (Cu) is included in the new alloy, and generally in the range of from 3.5 wt. % to 4.4 wt. % Cu. In one embodiment, the new alloy includes at least 3.6 wt. % Cu. In other embodiments, the new alloy may include at least 3.7 wt. % Cu, or at least 3.8 wt. % Cu. In one embodiment, the new alloy includes not greater than 4.3 wt. % Cu. In other embodiments, the new alloy may include not greater than 4.2 wt. % Cu.

Magnesium (Mg) is included in the new alloy, and generally in the range of from 0.45 wt. % to 0.75 wt. % Mg. In one embodiment, the new alloy includes at least 0.50 wt. % Mg. In another embodiment, the new alloy includes at least 0.55 wt. % Mg. In one embodiment, the new alloy includes not greater than 0.70 wt. % Mg. In another embodiment, the new alloy includes not greater than 0.65 wt. % Mg.

Zinc (Zn) is included in the new alloy, and in the range of from 0.45 wt. % to 0.75 wt. % Zn. In one embodiment, the new alloy includes at least 0.50 wt. % Zn. In another embodiment, the new alloy includes at least 0.55 wt. % Zn. In one embodiment, the new alloy includes not greater than 0.70 wt. % Zn. In another embodiment, the new alloy includes not greater than 0.65 wt. % Zn.

The Zn/Mg ratio may be centered around 1.00, such as in the range of from 0.60 to 1.67 (Zn/Mg). In one embodiment, the Zn/Mg ratio is in the range of from 0.70 to 1.40. In another embodiment, the Zn/Mg ratio is in the range of from 0.80 to 1.20. In yet another embodiment, the Zn/Mg ratio is in the range of from 0.85 to 1.15.

Lithium (Li) is included in the new alloy, and generally in the range of from 0.65 wt. % to 1.15 wt. % Li. In one embodiment, the new alloy includes at least 0.70 wt. % Li. In other embodiments, the new alloy may include at least 0.75 wt. % Li, or at least 0.80 wt. % Li, or at least 0.825 wt. % Li, or at least 0.850 wt. % Li, or at least 0.875 wt. % Li. In one embodiment, the new alloy includes not greater than 1.10 wt. % Li. In other embodiments, the new alloy includes not greater than 1.05 wt. % Li, or not greater than 1.025 wt. % Li, or not greater than 1.000 wt. % Li, or not greater than 0.975 wt. % Li, or not greater than 0.950 wt. % Li.

Silver (Ag) is included in the new alloy, and generally in the range of from 0.1 wt. % to 1.0 wt. % Ag. In one embodiment, the new alloy includes at least 0.15 wt. % Ag. In another embodiment, the new alloy includes at least 0.2 wt. % Ag. In one embodiment, the new alloy includes not greater than 0.5 wt. % Ag. In another embodiment, the new alloy includes not greater than 0.4 wt. % Ag.

Manganese (Mn) may optionally be included in the new alloy, and in an amount up to 1.0 wt. %. In one embodiment, the new alloy includes at least 0.05 wt. % Mn. In other embodiments, the new alloy includes at least 0.10 wt. % Mn, or at least 0.15 wt. % Mn, or at least 0.2 wt. % Mn. In one embodiment, the new alloy includes not greater than 0.8 wt. % Mn. In other embodiments, the new alloy includes not greater than 0.7 wt. % Mn, or not greater than 0.6 wt. % Mn, or not greater than 0.5 wt. % Mn, or not greater than 0.4 wt. % Mn. In the alloying industry, manganese may be considered both an alloying ingredient and a grain structure control element—the manganese retained in solid solution may enhance a mechanical property of the alloy (e.g., strength), while the manganese in particulate form (e.g., as $Al_6Mn$, $Al_{13}Mn_3Si_2$—sometimes referred to as dispersoids) may assist with grain structure control. However, since Mn is separately defined with its own composition limits in the present patent application, it is not within the definition of "grain structure control element" (described below) for the purposes of the present patent application.

The alloy may include 0.05 to 0.50 wt. % of at least one grain structure control element selected from the group consisting of zirconium (Zr), scandium (Sc), chromium (Cr), vanadium (V) and/or hafnium (Hf), and/or rare earth elements, and such that the utilized grain structure control element(s) is/are maintained below maximum solubility and/or at levels that restrict the formation of primary particles. As used herein, "grain structure control element" means elements or compounds that are deliberate alloying additions with the goal of forming second phase particles, usually in the solid state, to control grain structure changes during thermal processes, such as recovery and recrystallization. For purposes of the present patent application, grain structure control elements include Zr, Sc, Cr, V, Hf, and rare earth elements, to name a few, but excludes Mn.

The amount of grain structure control material utilized in an alloy is generally dependent on the type of material utilized for grain structure control and/or the alloy production process. In one embodiment, the grain structure control element is Zr, and the alloy includes from 0.05 wt. % to 0.20 wt. % Zr. In another embodiment, the alloy includes from 0.05 wt. % to 0.15 wt. % Zr. In another embodiment, the alloy includes 0.07 to 0.14 wt. % Zr. In one embodiment, the aluminum alloy includes at least 0.07 wt. % Zr. In another embodiment, the aluminum alloy includes at least 0.08 wt. % Zr. In one embodiment, the aluminum alloy includes not greater than 0.18 wt. % Zr. In another embodiment, the aluminum alloy includes not greater than 0.15 wt. % Zr. In another embodiment, the aluminum alloy includes not greater than 0.14 wt. % Zr.

The alloy may include up to 0.15 wt. % Ti cumulatively for grain refining and/or other purposes. When Ti is included in the alloy, it is generally present in an amount of from 0.005 to 0.10 wt. %. In one embodiment, the aluminum alloy includes a grain refiner, and the grain refiner is at least one of $TiB_2$ and TiC, where the wt. % of Ti in the alloy is from 0.01 to 0.06 wt. %, or from 0.01 to 0.03 wt. %.

The aluminum alloy may include iron (Fe) and silicon (Si), typically as impurities. The iron content of the new alloy should generally not exceed 0.15 wt. %. In one embodiment, the iron content of the alloy is not greater than 0.12 wt. %. In other embodiments, the aluminum alloy includes not greater than 0.10 wt. % Fe, or not greater than 0.08 wt. % Fe, or not greater than 0.05 wt. % Fe, or not greater than 0.04 wt. % Fe. Similarly, the silicon content of the new alloy should generally not exceed 0.12 wt. %. In one embodiment, the silicon content of the alloy is not greater than 0.10 wt. % Si, or not greater than 0.08 wt. % Si, or not greater than 0.06 wt. % Si, or not greater than 0.04 wt. % Si, or not greater than 0.03 wt. % Si.

The new 2xxx aluminum lithium alloys generally contain low amounts of "other elements" (e.g., casting aids and impurities, other than the iron and silicon). As used herein, "other elements" means any other element of the periodic table except for aluminum and the above-described copper, magnesium, zinc, lithium, silver, manganese, grain structure control elements (i.e., Zr, Sc, Cr, V Hf, and rare earth elements), iron, and silicon, described above. In one embodiment, the new 2xxx aluminum lithium alloys contain not more than 0.10 wt. % each of any other element, with the total combined amount of these other elements not exceeding 0.35 wt. %. In another embodiment, each one of these other elements, individually, does not exceed 0.05 wt. % in the 2xxx aluminum lithium alloy, and the total combined amount of these other elements does not exceed 0.15 wt. % in the 2xxx aluminum lithium alloy. In another embodiment, each one of these other elements, individually, does not exceed 0.03 wt. % in the 2xxx aluminum lithium alloy, and the total combined amount of these other elements does not exceed 0.10 wt. % in the 2xxx aluminum lithium alloy.

The new alloys may be used in all wrought product forms, including sheet, plate, forgings and extrusions. The new alloy can be prepared into wrought form, and in the appropriate temper, by more or less conventional practices, including direct chill (DC) casting the aluminum alloy into ingot form. After conventional scalping, lathing or peeling (if needed) and homogenization, which homogenization may be completed before or after scalping, these ingots may be further processed by hot working the product with or without annealing between hot rolling operations. The product may then be optionally cold worked, optionally annealed, solution heat treated, quenched, and final cold worked. After the final cold working step, the product may be artificially aged. Thus, the products may be produced in a T3 or T8 temper.

The new alloys may realize improved properties, such as improved, strength and/or corrosion resistance, and with a similar or improved trade-off between strength and fracture toughness. In one embodiment, a wrought aluminum alloy product made from the new aluminum alloy passes ASTM G47 for at least 50 days (average of 5 specimens) at a stress of at least 45 ksi. In another embodiment, a wrought aluminum alloy product made from the new aluminum alloy passes ASTM G47 for at least 60 days (average of 5 specimens) at a stress of at least 45 ksi. In yet another embodiment, a wrought aluminum alloy product made from the new aluminum alloy passes ASTM G47 for at least 70 days (average of 5 specimens) at a stress of at least 45 ksi. In another embodiment, a wrought aluminum alloy product made from the new aluminum alloy passes ASTM G47 for at least 80 days (average of 5 specimens) at a stress of at least 45 ksi. In any of the above embodiments, the wrought aluminum alloy may realize a tensile yield strength (L) (TYS-L), when tested in accordance with ASTM E8 and B557, of at least about 70 ksi, such as a TYS-L of at least 71 ksi, or a TYS-L of at least 72 ksi, or a TYS-L of at least 73 ksi, or a TYS-L of at least 74 ksi, or a TYS-L of at least 75 ksi, or a TYS-L of at least 76 ksi, or a TYS-L of at least 77 ksi, or a TYS-L of at least 78 ksi, or a TYS-L of at least 79 ksi, or a TYS-L of at least 80 ksi, or a TYS-L of at least 81 ksi, or a TYS-L of at least 82 ksi, or a TYS-L of at least 83 ksi, or a TYS-L of at least 84 ksi, or a TYS-L of at least 85 ksi, or or a TYS-L of at least 86 ksi, or more. In any of the above embodiments, the wrought aluminum alloy may realize a plain strain ($K_{Ic}$) fracture toughness (T-L), when tested in accordance with ASTM E399, of at least about 20 ksi, such as a $K_{Ic}$ (T-L) of at least 21 ksi, or a $K_{Ic}$ (T-L) of at least 22 ksi, or a $K_{Ic}$ (T-L) of at least 23 ksi, or a $K_{Ic}$ (T-L) of at least 24 ksi, or a $K_{Ic}$ (T-L) of at least 25 ksi, or a $K_{Ic}$ (T-L) of at least 26 ksi, or a $K_{Ic}$ (T-L) of at least 27 ksi, or a $K_{Ic}$ (T-L) of at least 28 ksi, or a $K_{Ic}$ (T-L) of at least 29 ksi, or a $K_{Ic}$ (T-L) of at least 30 ksi, or a $K_{Ic}$ (T-L) of at least 31 ksi, or a $K_{Ic}$ (T-L) of at least 32 ksi, or a $K_{Ic}$ (T-L) of at least 33 ksi, or more.

Unless otherwise indicated, the following definitions apply to the present application:

"Wrought aluminum alloy product" means an aluminum alloy product that is hot worked after casting, and includes rolled products (sheet or plate), forged products, and extruded products.

"Forged aluminum alloy product" means a wrought aluminum alloy product that is either die forged or hand forged.

"Solution heat treating" means exposure of an aluminum alloy to elevated temperature for the purpose of placing solute(s) into solid solution.

"Artificially aging" means exposure of an aluminum alloy to elevated temperature for the purpose of precipitating solute(s). Artificial aging may occur in one or a plurality of steps, which can include varying temperatures and/or exposure times.

These and other aspects, advantages, and novel features of this new technology are set forth in part in the description that follows and will become apparent to those skilled in the art upon examination of the following description and figures, or may be learned by practicing one or more embodiments of the technology provided for by the present disclosure.

BRIEF DESCRIPTION OF THE DRAWINGS

FIG. 1 is a graph illustrating the performance of various aluminum alloy products of Example 1.

FIGS. 2*a*-2*b* are graphs illustrating the performance of various aluminum alloy products of Example 2.

DETAILED DESCRIPTION

Example 1

Bookmold Study

Nine book mold ingots were produced, the compositions of which are provided in Table 1, below (all values in weight percent).

TABLE 1

Example 1 Alloy Compositions

| Alloy | Cu | Mg | Mn | Zn | Ag | Li | Zn/Mg ratio | Density (g/cm$^3$) |
|---|---|---|---|---|---|---|---|---|
| 1 | 3.95 | 0.78 | 0.28 | 0.37 | 0.25 | 0.82 | 0.47 | 2.725 |
| 2 | 3.54 | 0.43 | 0.27 | 0.21 | 0.35 | 0.92 | 0.49 | 2.710 |
| 3 (Inv.) | 3.87 | 0.57 | 0.28 | 0.63 | 0.34 | 0.94 | 1.11 | 2.728 |
| 4 (Inv.) | 4.25 | 0.59 | 0.27 | 0.65 | 0.35 | 0.89 | 1.10 | 2.728 |
| 5 | 4.16 | 0.58 | 0.26 | 0.01 | 0.35 | 0.9 | 0.02 | 2.718 |
| 6 | 4.1 | 0.58 | 0.27 | 0.32 | 0.35 | 0.91 | 0.55 | 2.723 |
| 7 | 4.2 | 0.58 | 0.29 | 0.97 | 0.35 | 0.93 | 1.67 | 2.733 |
| 8 | 4.2 | 0.44 | 0.28 | 0.65 | 0.35 | 0.93 | 1.48 | 2.732 |
| 9 | 4.17 | 0.77 | 0.28 | 0.65 | 0.35 | 0.93 | 0.84 | 2.725 |

All alloys contained not greater than 0.03 wt. % Si, not greater than 0.04 wt. % Fe, about 0.02 wt. % Ti, about 0.11-0.12 wt. % Zr, the balance being aluminum and other impurities, where the other impurities did not exceed more than 0.05 wt. % each, and not more than 0.15 wt. % total of the other impurities.

The alloys were cast as 2.875 inches (ST)×4.75 inches (LT)×17 inches (L) ingots that were scalped to 2 inches thick and homogenized. The ingots were then hot rolled to about 0.82 inch, corresponding to a ~60% reduction. The plates were subsequently solution heat-treated, quenched in hot water at 195 F, and then stretched about 6%. The hot water quench simulates a quench rate of about a 3 inch thick plate. After stretching, the alloys were subsequently aged at about 310° F. for various times, representing underaged conditions and up to a peak strength condition (aging times varied as a function of the alloy composition). The strength and toughness of the alloys were tested in accordance with ASTM E8, B557, E399 and B645, the results of which are illustrated in FIG. 1, and in Table 4, below (duplicate specimens for strength and elongation; single specimens for fracture toughness).

As shown in FIG. 1, alloys 3-4 realized an improved strength-toughness relationship over alloys 1-2 and 5-9. It is suspected that the combination of alloying elements in alloys 3-4 realizes a synergistic effect. Indeed, alloys 3-4 realize an improved strength-toughness combination over the next closest alloy (alloy 1) with an increase in tensile yield strength (TYS) of about 2 to 4 ksi (and an increase in ultimate tensile strength (UTS) of about 3 to 5 ksi) at similar toughness. These results indicate that 2xxx alloys having 3.5-4.4 wt. % Cu, about 0.45-0.75 wt. % Mg, 0.45-0.75 wt. % Zn, 0.65-1.15 wt. % Li, 0.1-1.0 wt. % Ag, 0.05 to 0.50 wt. % of a grain structure control element selected from the group consisting of Zr, Sc, Cr, V, Hf, rare earth elements, and combinations thereof, up to 1.0 wt. % Mn, up to 0.15 wt. % Ti, up to 0.12 wt. % Si, up to 0.15 wt. % Fe, up to 0.10 wt. % of any other element, with the total of these other elements not exceeding 0.35 wt. %, the balance being aluminum, may achieve an improved strength-toughness relationship.

For example, alloy 1 contains about the same amount of copper and lithium as alloys 3-4, but alloy 1 contains too much magnesium and not enough zinc. Alloy 2 contains too little magnesium and zinc. Alloys 5 and 6 contain too little zinc. Alloy 7 contains too much zinc. Alloy 8 contains too little magnesium. Alloy 9 contains too much magnesium. It would therefore appear that alloys having a Zn/Mg ratio of about 1.0 along with appropriate amounts of Cu, Mg, Zn, Li, Ag, and (optionally) Mn realize an improved strength-toughness relationship.

Initial evaluations of SCC resistance in the ST direction were conducted using C-rings tested in alternate immersion (per ASTM G47), the results of which are provided in Tables 2-3, below. Alloys 3 and 4 realized good corrosion resistance properties.

TABLE 2

SCC testing at 45 ksi

| | SCC failures at 45 ksi in Alternate Immersion (ASTM G47) - 0.720" C-ring - T/2 - ST 1-step age at 310 F. | | | |
|---|---|---|---|---|
| Alloy | 15 h | 20 h | 30 h | 40 h |
| Alloy 1 | — | 3/3 (22, 22, 22) | 1/3 (25) | 2/3 (25, 25)** |
| Alloy 2 | — | 1/3 (25) | 2/3 (25, 25) | 0/3** |
| Alloy 3 | 0/3 | 2/3 (25, 25) | 0/2 | 1/3 (25)** |
| Alloy 4 | 0/3 | 0/3** | 0/3 | 0/3 |
| Alloy 5 | — | 0/3 | 0/3** | 0/3 |
| Alloy 6 | 0/3 | 0/3** | 0/3 | 0/3 |
| Alloy 7 | 0/3 | 0/3** | 1/3 (25) | 0/3 |
| Alloy 8 | 0/3 | 0/3 | 0/3** | 0/3 |
| Alloy 9 | 3/3 (25, 60, 4) | 0/3 | 0/3** | 0/3 |

**= peak strength

TABLE 3

SCC testing at 55 ksi

| Alloy | SCC failures at 55 ksi in Alternate Immersion (ASTM G47) - 0.720" C-ring - T/2 - ST 1-step age at 310 F. | | | |
|---|---|---|---|---|
| | 15 h | 20 h | 30 h | 40 h |
| Alloy 1 | — | 3/3 (14, 14, 14) | 1/3 (14) | 2/3 (14, 14)** |
| Alloy 2 | — | 1/3 (14) | 2/3 (28, 21) | 1/3 (35)** |
| Alloy 3 | 0/3 | 0/2 | — | 0/1** |
| Alloy 4 | 0/3 | 0/3** | 1/3 (35) | — |
| Alloy 5 | — | 0/3 | 0/3** | — |
| Alloy 6 | 0/3 | 0/3** | 0/3 | — |
| Alloy 7 | 0/3 | 0/3** | 0/3 | — |
| Alloy 8 | 0/3 | 0/3 | 1/3 (21)** | — |
| Alloy 9 | 3/3 (4, 4, 11) | 1/3 (21) | 0/3** | — |

**= peak strength

TABLE 4

Mechanical Properties of Ex. 1 Alloys

| Alloy | Aging Time (hours) | TYS (ksi) | UTS (ksi) | Total El (%) | $K_{Ic}$ (ksi√in.) |
|---|---|---|---|---|---|
| 1 | 10 | 78.2 | 81.6 | 8.5 | 31.2 |
| | 40 | 82.7 | 85.0 | 9.0 | 26.1 |
| 2 | 20 | 75.4 | 79.0 | 10.0 | 27.3 |
| | 40 | 76.4 | 80.1 | 10.0 | 28.4 |
| 3 | 15 | 86.4 | 89.7 | 8.5 | 26.3 |
| | 20 | 87.2 | 90.1 | 7.0 | 23.8 |
| 4 | 15 | 85.2 | 88.3 | 7.5 | 26.5 |
| | 20 | 87.0 | 90.2 | 7.0 | 23.2 |
| 5 | 20 | 82.1 | 85.3 | 9.0 | 28.0 |
| | 30 | 83.5 | 86.5 | 9.0 | 25.8 |
| 6 | 15 | 83.4 | 86.5 | 8.0 | 25.5 |
| | 20 | 84.1 | 87.0 | 8.0 | 22.9** |
| 7 | 15 | 84.8 | 87.9 | 8.0 | 23.3** |
| | 20 | 85.7 | 88.9 | 7.0 | 20.3 |
| 8 | 15 | 84.6 | 87.6 | 8.0 | 26.2 |
| | 30 | 84.9 | 88.3 | 8.0 | 20.9 |
| 9 | 20 | 85.8 | 88.6 | 6.5 | 20.7** |
| | 30 | 85.2 | 88.3 | 7.0 | 18.6 |

**= $K_Q$

Example 2

Plant Trials

Two industrial size ingots were produced at an industrial facility, the compositions of which are provided in Table 5, below (all values in weight percent).

TABLE 5

Example 2 - Invention Alloy Compositions

| Alloy | Cu | Mg | Mn | Zn | Ag | Li | Zn/Mg ratio | Density (g/cm³) |
|---|---|---|---|---|---|---|---|---|
| 10 | 3.80 | 0.61 | 0.29 | 0.69 | 0.35 | 0.87 | 1.13 | 2.718 |
| 11 | 3.80 | 0.58 | 0.29 | 0.59 | 0.32 | 0.86 | 1.02 | 2.718 |

All alloys contained not greater than 0.03 wt. % Si, not greater than 0.05 wt. % Fe, about 0.01-0.02 wt. % Ti, about 0.07-08 wt. % Zr, the balance being aluminum and other impurities, where the other impurities did not exceed more than 0.05 wt. % each, and not more than 0.15 wt. % total of the other impurities.

After scalping, the ingots were homogenized, then hot rolled into plate of various gauges. Specifically, Alloy 10 was hot rolled to 3 inch (76 mm) gauge, and Alloy 11 was hot rolled to 2 inch (51 mm) and 1.5 inch (38 mm) gauge. After hot rolling, the plates were solution heat treated, cold water quenched, and then stretched about 6%. The plates were then artificially aged at 310° F. for various times.

A comparison conventional alloy was also cast at another industrial facility, and its composition is shown in Table 5, below (all values in weight percent). The comparison alloy is similar to those disclosed in commonly-owned U.S. Pat. No. 7,438,772.

TABLE 6

Example 2 - Conventional Alloy Composition

| Alloy | Cu | Mg | Mn | Zn | Ag | Li | Zn/Mg Ratio | Density (g/cm³) |
|---|---|---|---|---|---|---|---|---|
| 12 | 3.96 | 0.79 | 0.30 | 0.34 | 0.25 | 0.71 | 0.43 | 2.727 |

Alloy 12 contained not greater than 0.03 wt. % Si, not greater than 0.04 wt. % Fe, about 0.03 wt. % Ti, about 0.13 wt. % Zr, the balance being aluminum and other impurities, where the other impurities did not exceed more than 0.05 wt. % each, and not more than 0.15 wt. % total of the other impurities.

After scalping, the ingot was homogenized, then hot rolled into a 2.5 inch plate. After hot rolling, the plate was solution heat treated, cold water quenched, and then stretched about 6%. The plate was then artificially aged using a two-step aging practice. Specifically, the alloys were first-step aged at 290° F. and 310° F. for various times, and then second step aged at 225° F. for 12 hours.

After processing, the strength and toughness of the invention and conventional plates were tested in accordance with ASTM E8, B557, E399 and B645. The results are provided in Tables 7-8, below. Strength and elongation tests were conducted at T/4 for the L (longitudinal) and LT (long transverse) directions, and at T/2 for the ST (short transverse) direction. Fracture toughness values ($K_{Ic}$) are at T/2 for both T-L and S-L.

TABLE 7

Mechanical Properties of Invention Alloys 10-11

| Alloy | Plate Gauge (in) | Aging time (hrs @ 310° F.) | Test Orient. | TYS (ksi) | UTS (ksi) | Elong. (%) | $K_{Ic}$ (ksi√in.) |
|---|---|---|---|---|---|---|---|
| 11 (Inv.) | 1.5 | 8 | L | 80.8 | 84.8 | 8.6 | — |
| | 1.5 | 12 | L | 82.2 | 86.2 | 7.9 | — |
| | 1.5 | 16 | L | 83.8 | 87.8 | 7.5 | — |
| | 1.5 | 24 | L | 83.9 | 87.7 | 6.4 | — |
| | 1.5 | 36 | L | 84.4 | 88.0 | 5.7 | — |
| | 1.5 | 8 | LT | 74.8 | 84.0 | 7.5 | 32.6 |
| | 1.5 | 12 | LT | 77.3 | 85.6 | 7.1 | 30.1 |
| | 1.5 | 16 | LT | 79.9 | 87.5 | 4.3 | 27.3 |
| | 1.5 | 24 | LT | 80.3 | 88.0 | 4.3 | 26.3 |
| | 1.5 | 36 | LT | 79.0 | 87.5 | 4.3 | 24.4 |
| | 1.5 | 8 | ST | 67.5 | 78.5 | 8.0 | 27.9 |
| | 1.5 | 12 | ST | 69.7 | 80.5 | 8.0 | 26.6 |
| | 1.5 | 16 | ST | 71.6 | 82.1 | 8.0 | 26.0 |
| | 1.5 | 24 | ST | 71.5 | 82.1 | 6.0 | 22.9 |
| | 1.5 | 36 | ST | 72.4 | 82.3 | 6.0 | 21.5 |

TABLE 7-continued

Mechanical Properties of Invention Alloys 10-11

| Alloy | Plate Gauge (in) | Aging time (hrs @ 310° F.) | Test Orient. | TYS (ksi) | UTS (ksi) | Elong. (%) | $K_{Ic}$ (ksi√in.) |
|---|---|---|---|---|---|---|---|
| 11 | 2.0 | 8 | L | 79.6 | 83.5 | 7.1 | — |
| (Inv.) | 2.0 | 12 | L | 82.0 | 85.8 | 7.1 | — |
| | 2.0 | 16 | L | 82.2 | 86.4 | 7.1 | — |
| | 2.0 | 24 | L | 83.0 | 86.7 | 6.4 | — |
| | 2.0 | 36 | L | 83.0 | 87.0 | 5.7 | — |
| | 2.0 | 8 | LT | 72.1 | 82.4 | 7.1 | 31.9 |
| | 2.0 | 12 | LT | 76.7 | 85.1 | 5.7 | 28.3 |
| | 2.0 | 16 | LT | 77.8 | 86.0 | 5.0 | 26.7 |
| | 2.0 | 24 | LT | 78.3 | 86.3 | 4.3 | 24.6 |
| | 2.0 | 36 | LT | 78.8 | 86.5 | 4.3 | 24.0 |
| | 2.0 | 8 | ST | 66.9 | 77.6 | 7.8 | 28.7 |
| | 2.0 | 12 | ST | 69.7 | 80.2 | 6.2 | 25.8 |
| | 2.0 | 16 | ST | 71.9 | 82.0 | 6.2 | 23.3 |
| | 2.0 | 24 | ST | 72.1 | 82.3 | 5.5 | 22.4 |
| | 2.0 | 36 | ST | 73.5 | 82.6 | 4.7 | 21.6 |
| 10 | 3.0 | 8 | L | 75.4 | 80.0 | 7.9 | — |
| (Inv.) | 3.0 | 12 | L | 78.4 | 82.4 | 7.1 | — |
| | 3.0 | 16 | L | 80.3 | 84.3 | 6.8 | — |
| | 3.0 | 24 | L | 80.2 | 84.7 | 4.7 | — |
| | 3.0 | 36 | L | 81.3 | 85.0 | 5.0 | — |
| | 3.0 | 8 | LT | 71.4 | 80.7 | 7.1 | 30.3 |
| | 3.0 | 12 | LT | 74.1 | 83.3 | 5.7 | 26.9 |
| | 3.0 | 16 | LT | 76.3 | 85.1 | 5.0 | 24.5 |
| | 3.0 | 24 | LT | 76.6 | 85.7 | 5.0 | 23.1 |
| | 3.0 | 36 | LT | 77.5 | 85.5 | 4.3 | 22.2 |
| | 3.0 | 8 | ST | 66.8 | 78.3 | 6.0 | 24.5 |
| | 3.0 | 12 | ST | 69.4 | 79.9 | 6.0 | 25.1 |
| | 3.0 | 16 | ST | 71.9 | 82.2 | 5.0 | 20.9 |
| | 3.0 | 24 | ST | 72.6 | 82.3 | 5.0 | 20.6 |
| | 3.0 | 36 | ST | 73.0 | 82.2 | 5.0 | 18.3 |

TABLE 8

Mechanical Properties of Conventional Alloy 12 (2.5 inch plate)

| Test Orien-tation | Test Location | 1st step aging condition (temp ° F./hrs) | TYS (ksi) | UTS (ksi) | Elong. (%) | $K_{Ic}$ (ksi√in.) |
|---|---|---|---|---|---|---|
| L | T/4 | 290/48 | 75.4 | 79.0 | 12.9 | — |
| L | T/4 | 290/72 | 78.4 | 81.3 | 11.4 | — |
| L | T/4 | 290/96 | 79.0 | 81.9 | 12.1 | — |

TABLE 8-continued

Mechanical Properties of Conventional Alloy 12 (2.5 inch plate)

| Test Orien-tation | Test Location | 1st step aging condition (temp ° F./hrs) | TYS (ksi) | UTS (ksi) | Elong. (%) | $K_{Ic}$ (ksi√in.) |
|---|---|---|---|---|---|---|
| L | T/4 | 310/20 | 76.6 | 79.9 | 12.9 | — |
| L | T/4 | 310/30 | 78.8 | 81.6 | 11.4 | — |
| L | T/4 | 310/40 | 79.2 | 81.9 | 10.0 | — |
| LT | T/4 | 290/48 | 71.3 | 79.0 | 12.9 | 37.8 |
| LT | T/4 | 290/72 | 73.4 | 80.6 | 10.0 | 32.3 |
| LT | T/4 | 290/96 | 74.5 | 81.5 | 8.6 | 29.8 |
| LT | T/4 | 310/20 | 71.9 | 79.2 | 11.4 | 36.0 |
| LT | T/4 | 310/30 | 74.1 | 80.9 | 8.6 | 31.8 |
| LT | T/4 | 310/40 | 74.8 | 81.2 | 9.7 | 29.4 |
| ST | T/2 | 290/48 | 66.3 | 78.6 | 7.8 | 29.0 |
| ST | T/2 | 290/72 | 69.5 | 81.5 | 7.0 | 26.2 |
| ST | T/2 | 290/96 | 70.6 | 81.3 | 6.2 | 27.3 |
| ST | T/2 | 310/20 | 70.4 | 79.8 | 6.2 | 28.6 |
| ST | T/2 | 310/30 | 71.3 | 81.1 | 6.2 | 25.0 |
| ST | T/2 | 310/40 | 71.3 | 80.8 | 6.2 | 24.8 |

Alloys 10-12 were also evaluated SCC resistance in the ST direction in accordance with ASTM G44 (1999), 3.5% NaCl, Alternate Immersion and G47 (1998) (⅛" Diameter T-Bars—2 Inch), at a net stress of 45 ksi. The SCC results are illustrated in Table 9, below.

TABLE 9

SCC Properties of Invention Alloys 10-11

| Alloy | Gauge (in) | Aging time (hrs @ 310° F.) | Days to Failure Sample 1 | Sample 2 | Sample 3 | Ave. |
|---|---|---|---|---|---|---|
| 11 | 1.5 | 8 | 89 | 47 | 46 | 60.7 |
| | 1.5 | 12 | 52 | 46 | 57 | 51.7 |
| | 1.5 | 16 | 80 | 49 | 122+ | 83.7 |
| | 1.5 | 24 | 61 | 57 | 54 | 57.3 |
| | 1.5 | 36 | 14 | 19 | 6 | 13 |
| 11 | 2 | 8 | 89 | 18 | 38 | 48.3 |
| | 2 | 12 | 122+ | 50 | 61 | 77.7 |
| | 2 | 16 | 88 | 84 | 67 | 79.7 |
| | 2 | 24 | 35 | 61 | 70 | 55.3 |
| | 2 | 36 | 6 | 6 | 8 | 6.67 |
| 10 | 3 | 8 | 8 | 6 | 6 | 6.67 |
| | 3 | 12 | 30 | 36 | 50 | 38.7 |
| | 3 | 16 | 109 | 96 | 70 | 91.7 |
| | 3 | 24 | 94 | 116 | 122+ | 111 |
| | 3 | 36 | 42 | 54 | 74 | 56.7 |

TABLE 10

SCC Properties of Conventional Alloy 12

| Alloy | Gauge (in) | Aging time (hrs @ 310° F.) | Days to Failure Sample 1 | Sample 2 | Sample 3 | Sample 4 | Sample 5 | Ave. |
|---|---|---|---|---|---|---|---|---|
| 12 | 2.5 | 20** | 26 | 5 | 10 | 19 | 17 | 15.4 |
| | 2.5 | 30** | 38 | 56 | 34 | 45 | 34 | 41.4 |
| | 2.5 | 40** | 54 | 17 | 50 | 58 | 6 | 37 |

**included a second-step age of 12 hours at 225° F.

As shown above and in FIGS. 2a-2b, invention Alloys 10-11 realize higher strength over conventional Alloy 12, with a similar trade-off of strength and toughness. Invention Alloys 10-11 also realize unexpectedly better stress corrosion cracking resistance over conventional Alloy 12. For instance, at 16 hours of aging Invention Alloy 11 at 1.5 inches averaged about 84 days to failure and achieved a tensile yield strength (L) of 83.8 ksi. At 16 hours of aging Invention Alloy 11 at 2.0 inches averaged about 80 days to failure and achieved a tensile yield strength (L) of 82.2 ksi. At 16 hours of aging Invention Alloy 10 at 3.0 inches averaged about 92 days to failure and achieved a tensile yield strength (L) of 80.3 ksi. Conversely, at its best corrosion resistance (30 hours of aging), conventional Alloy 12 averaged about 41 days to failure and a tensile yield strength (L) of only 78.8 ksi. In other words, the invention Alloys 10-11 realize about double the stress corrosion cracking resistance over conventional Alloy 12 and with higher strength. Furthermore, the invention alloys have a lower density than conventional Alloy 12.

What is claimed is:

1. A wrought aluminum alloy product consisting of:
3.5-4.4 wt. % Cu;
0.45-0.75 wt. % Mg;
0.45-0.75 wt. % Zn;
wherein (wt. % Zn)/(wt. % Mg) is 0.60-1.67;
0.65-0.950 wt. % Li;
0.1-1.0 wt. % Ag;
from 0.05 to 0.50 wt. % of at least one grain structure control element, wherein the at least one grain structure control element is selected from the group consisting of Zr, Sc, Cr, V, Hf, rare earth elements, and combinations thereof;
up to 1.0 wt. % Mn;
up to 0.15 wt. % Ti;
up to 0.12 wt. % Si;
up to 0.15 wt. % Fe; and
the balance being aluminum and incidental impurities;
wherein the wrought aluminum alloy product has a thickness of at least 12.7 mm; and
wherein the wrought aluminum alloy product realizes a plane strain fracture toughness ($K_{IC}$) of at least 22 ksi√in.

2. The wrought aluminum alloy product of claim 1, comprising at least 3.7 wt. % Cu.

3. The wrought aluminum alloy product of claim 1, comprising not greater than 4.2 wt. % Cu.

4. The wrought aluminum alloy product of claim 1, comprising at least 0.55 wt. % Mg.

5. The wrought aluminum alloy product of claim 1, comprising not greater than 0.65 wt. % Mg.

6. The wrought aluminum alloy product of claim 1, comprising at least 0.55 wt. % Zn.

7. The wrought aluminum alloy product of claim 1, comprising not greater than 0.65 wt. % Zn.

8. The wrought aluminum alloy product of claim 1, wherein (wt. % Zn)/(wt. % Mg) is 0.70-1.40.

9. The wrought aluminum alloy product of claim 1, wherein (wt. % Zn)/(wt. % Mg) is 0.80-1.20.

10. The wrought aluminum alloy product of claim 1, comprising at least 0.75 wt. % Li.

11. The wrought aluminum alloy product of claim 1, comprising at least 0.825 wt. % Li.

12. The wrought aluminum alloy product of claim 1, comprising at least 0.875 wt. % Li.

13. The wrought aluminum alloy product of claim 1, comprising not greater than 0.5 wt. % Ag.

14. The wrought aluminum alloy product of claim 1, comprising at least 0.05 wt. % Mn.

15. The wrought aluminum alloy product of claim 1, comprising not greater than 0.5 wt. % Mn.

16. The wrought aluminum alloy product of claim 1, wherein the wrought aluminum alloy product realizes a plane strain fracture toughness ($K_{IC}$) of at least 23 ksi√in.

17. The wrought aluminum alloy product of claim 1, wherein the wrought aluminum alloy product realizes a plane strain fracture toughness ($K_{IC}$) of at least 24 ksi√in.

18. The wrought aluminum alloy product of claim 1, wherein the wrought aluminum alloy product realizes a plane strain fracture toughness ($K_{IC}$) of at least 25 ksi√in.

19. The wrought aluminum alloy product of claim 1, wherein the wrought aluminum alloy product realizes a plane strain fracture toughness ($K_{IC}$) of at least 26 ksi√in.

20. The wrought aluminum alloy product of claim 1, wherein the wrought aluminum alloy product realizes a plane strain fracture toughness ($K_{IC}$) of at least 27 ksi√in.

21. A rolled aluminum alloy product consisting of:
3.7-4.2 wt, % Cu;
0.55-0.65 wt. Mg;
0.55-0.65 wt. % Zn;
wherein (wt. % Zn)/(wt. % Mg) is 0.85-1.15;
0.75-0.950 wt. % Li;
0.10-0.50 wt. % Ag;
0.05-0.4 wt. % Mn,
0.07-0.14 wt. % Zr;
up to 0.15 wt, % Ti;
up to 0.12 wt. % Si;
up to 0.15 wt. % Fe; and
the balance being aluminum and incidental impurities;
wherein the rolled aluminum alloy product has a thickness of from 25.4 mm to 101.6 mm; and
wherein the rolled aluminum alloy product realizes a plane strain fracture toughness ($K_{IC}$) of at least 22 ksi√in.

22. The rolled aluminum alloy product of claim 21, comprising at least 0.825 wt. % Li.

23. The rolled aluminum alloy product of claim 21, comprising at least 0.875 wt. % Li.

24. The rolled aluminum alloy product of claim 21, wherein the rolled aluminum alloy product realizes a plane strain fracture toughness ($K_{IC}$) of at least 23 ksi√in.

25. The rolled aluminum alloy product of claim 21, wherein the rolled aluminum alloy product realizes a plane strain fracture toughness ($K_{IC}$) of at least 24 ksi√in.

26. The rolled aluminum alloy product of claim 21, wherein the rolled aluminum alloy product realizes a plane strain fracture toughness ($K_{IC}$) of at least 25 ksi√in.

27. The rolled aluminum alloy product of claim 21, wherein the roiled aluminum alloy product realizes a plane strain fracture toughness ($K_{IC}$) of at least 26 ksi√in.

28. The rolled aluminum alloy product of claim 21, wherein the rolled aluminum alloy product realizes a plane strain fracture toughness ($K_{IC}$) of at least 27 ksi√in.

* * * * *